US007162756B2

(12) United States Patent
Schweigert

(10) Patent No.: US 7,162,756 B2
(45) Date of Patent: Jan. 16, 2007

(54) BED COVER WITH ISOLATED CHAMBERS CAPABLE OF BEING MOVED APART

(75) Inventor: Erich Schweigert, Lörrach (DE)

(73) Assignee: OBB Oberbadische Bettfedernfabrik GmbH, Lorrach (DE)

( * ) Notice: Subject to any disclaimer, the term of this patent is extended or adjusted under 35 U.S.C. 154(b) by 0 days.

(21) Appl. No.: 11/108,365

(22) Filed: Apr. 18, 2005

(65) Prior Publication Data

US 2006/0179570 A1 Aug. 17, 2006

(30) Foreign Application Priority Data

Feb. 16, 2005 (DE) ..... 10 2005 007 201

(51) Int. Cl.
*A47G 9/02* (2006.01)

(52) U.S. Cl. ..... 5/502; 112/420

(58) Field of Classification Search ..... 5/500, 5/502; 112/402, 420, 421; 428/156
See application file for complete search history.

(56) References Cited

U.S. PATENT DOCUMENTS

| | | | | |
|---|---|---|---|---|
| 681,573 | A * | 8/1901 | Nichols | 5/722 |
| 1,569,955 | A * | 1/1926 | Falter | 428/102 |
| 3,293,671 | A * | 12/1966 | Griffin | 5/655.9 |
| 4,275,473 | A * | 6/1981 | Poirier | 441/128 |
| 5,360,653 | A * | 11/1994 | Ackley | 428/71 |
| 6,301,730 | B1 * | 10/2001 | Delfs et al. | 5/502 |
| 6,961,970 | B1 * | 11/2005 | Pedersen | 5/502 |

FOREIGN PATENT DOCUMENTS

| | | |
|---|---|---|
| DE | 38 43 426 | 12/1990 |
| DE | 92 01 666.9 | 6/1992 |
| DE | 100 35 265 | 2/2001 |
| DE | 203 16 576 | 3/2004 |
| GB | 2 159 050 | 11/1985 |
| JP | 72 75 100 | 10/1995 |
| WO | WO 2005/016082 | 2/2005 |

* cited by examiner

*Primary Examiner*—Michael Trettel
(74) *Attorney, Agent, or Firm*—Volpe & Koenig, P.C.

(57) ABSTRACT

A bed cover (1) with isolated or quilted chambers (3) running parallel to one edge (2) of the bed cover and filled with a heat-insulating material, which is useable in both summer and winter based on different positioning thereof. For this, the neighboring separate chambers (3) are attached, especially sewn, to a flat cloth or similar flat part (4) so that when the flat cloth layer (4) is bent or curved in a sense of an arching of the chambers (3), neighboring boundaries or walls (5) of the chambers (3) are moved apart relative to one another, and in the case of a bend or curvature in an opposite direction the boundaries or walls (5) of the filled chambers (3) come into contact with one another to provide a better insulation. It is provided that in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least a first portion (5*a*) of the outward extent. This provides good insulation in the winter use position even in the case of a slight arching.

11 Claims, 2 Drawing Sheets

BED COVER WITH ISOLATED CHAMBERS CAPABLE OF BEING MOVED APART

FIELD OF THE INVENTION

The invention relates to a bed cover with isolated or quilted chambers running parallel to one edge of the bed cover, filled with a heat-insulating material, whereby the neighboring distinct chambers are attached, especially sewn, to a flat cloth layer or the like which forms one surface of the bed cover, so that when the flat cloth layer is curved or bent in the sense of an arching up of the chambers, the boundaries or walls between these chambers can be or are moved apart, and in the case of bending in the other direction the boundaries or walls of the filled chambers lie next to one another.

BACKGROUND OF THE INVENTION

This type of bed cover is described in DE 203 16 576 U1 and is well-known. It is particularly advantageous that, since the walls of the chambers move apart when the cover is pushed outwards and that they move together when the cover is bent in the other direction, the bed cover can be used as desired in the summer or in the winter with different heat penetrability, as described in DE 203 16 576 U1.

However, it has proved particularly in the curvature of the bed cover used in winter that the neighboring walls or boundaries of neighboring chambers do not lie sufficiently close to one another if the sleeper is particularly slim and perhaps also sleeps on his or her back, so that the bend in the bed cover is relatively slight. Moreover, there are parts of the body which, due to their small cross-sections, cause the bed cover to arch up less, particularly the often cold-sensitive legs and feet of a sleeping person, so that in these areas even in the winter position the bed cover still allows too great a heat penetrability.

SUMMARY

Therefore, the invention is based on the objective of providing a bed cover of the type described above, which provides good heat penetrability in the summer position, but still provides good insulation in the winter position even in the case of a slight arching.

To meet this apparently contradictory objective, the previously defined bed cover is improved due to the fact that in the spread out, non-arched position of the bed cover the neighboring boundaries or walls have a smaller distance from one another over a first portion of their extent going out from the cloth layer than in the further portion of this extent, or that they are in contact with one another in at least a first part of their extent.

This results in the fact that in the winter position, in which the cloth layer is on the top side of the bed cover, there is in any case a denser compression of the chambers at their boundaries or walls, even though the arching is slight. Since the walls or chambers then lie very close to one another in at least a first portion of their height or even touch one another in the beginning, they can at the same time be somewhat bunched and thus densely packed together in order to provide good heat insulation. This is particularly true if the walls of the chambers are in contact over their entire height in the starting position, or if this applies only to a first portion of their extent. In the reverse position and curvature, then the walls are moved apart, resulting in a larger heat penetrability, so that this position is appropriate for use in summer or in case of greater external heat.

A good compromise between good heat relief in summer and reliable insulation in winter can be achieved if the boundaries or walls of the chambers contact one another over about half of their extent extending out from the cloth layer in the spread, or non-arched, bed cover, and that they diverge from one another over their further extent.

This can particularly be achieved in a preferred embodiment in that the individual filled chambers have a cross-section roughly at right angles to the cloth layer comprising a rectangle located immediately adjacent the cloth layer and a trapezoid proceeding from that, whereby the slanted sides of the trapezoid form the diverging areas of the walls or boundaries of the chamber and the shorter of the parallel sides of the trapezoid is located on the upper side of the chambers away from the cloth layer and thus on the upper side of the bed cover. This form is also possible if the part of the extent in which the walls or boundaries of neighboring chambers in contact with one another in the starting position represent less or more than half of the overall height of a chamber.

The cross-section of the boundaries or walls of the chambers in the upper area can have an angle of about 45° from a horizontal or vertical plane. On the one hand, this results in a divergence of the walls or boundaries even in a bed cover lying flat, so that especially in summer there is a good heat penetrability, and on the other hand this results in a visually appropriate appearance because the bed cover then has characteristically separate chambers which can be shaped differently from one another. Experiments have shown that when the bed cover is arched in the winter position the zone of slanted boundaries achieves good contact with the neighboring region, because the non-slanted area of the walls, which are already originally in contact, are bunched up from the arching and thus the slanted portion is somewhat more vertical, nearing the neighboring area of the neighboring chamber and coming into contact with it.

The arrangement described in the invention can be used to advantage in a bed cover which has neighboring chambers running in only one direction of orientation, preferably in a lengthwise direction. It is, however, particularly advantageous, particularly in the summer position with a higher heat penetrability, if at least some of the chambers are subdivided at right angles to their lengthwise extent, and if the resulting individual chambers have a larger cross-section along the lengthwise direction of the subdivided chambers than in the crosswise direction, and if the boundaries at the subdivisions of the individual chambers also have a smaller distance from one another or are in contact along at least a first portion of their extent from the cloth layer, and/or the further portion of their extent has an increasing distance from neighboring walls or boundaries, whereby this further extent of the walls preferably diverges at an angle of 45°. Chambers running lengthwise can also be subdivided into individual chambers and in the area of the subdivision can be constructed relative to their walls or boundaries in the same or a similar way as the lengthwise walls or boundaries, in order to enable a larger or smaller heat penetrability according to the direction of arching of the bed cover. Such a subdivision of lengthwise chambers across their length and the formation of individual chambers also results in additional places which can be moved apart from one another when the cover and the chambers attached to its cloth layer is arched, while when the bed cover is used in the reversed position, these places have a good insulating effect due to their mutual contact.

The boundaries of the chambers and subchambers can extend to the cloth layer even in the crosswise subdivisions and, when bent or arched toward one another, can lie flat against one another, particularly over their entire surface, in order to achieve good heat insulation in this position.

Since particularly the middle area of such a bed cover is curved more sharply by a sleeping person and that is where the most heat should be passed through in summer, it is appropriate if at least the parallel chambers in the middle area of the bed cover are subdivided into crosswise subchambers, particularly into several subdivisions.

At least the chambers located directly at the edge of the bed cover and running parallel to that edge can be exempted from subdivision, or at least subdivided only at one or both ends, so that the bed cover can form a good seal in this area and prevent the entry of air under the bed cover as much as possible.

By subdividing the chambers into subchambers, it is possible that the chambers and/or the subchambers, along with their dimensions and their number, can be arranged according to the body. The human anatomy can also be taken appropriately into account in the subdivision into chambers and subchambers.

It is advantageous if the filled chambers run parallel to the longer edges of the rectangular bed cover and the subdivisions of these chambers into subchambers are oriented parallel to the shorter edges of the bed cover, so that in general square or rectangular subchambers are formed.

Additional variations are provided below.

Particularly from the combination of one or more of the features and measures described above and throughout the application, a bed cover results which enables improved heat insulation in its winter position because the neighboring walls or boundaries of the chambers making up the bed cover are already close to one another or in contact with one another in the original position and are then pressed firmly together in the winter position, while in the summer position, due to the folding apart of the individual chambers in the area of their boundaries, a good heat penetrability is still possible.

BRIEF DESCRIPTION OF THE DRAWINGS

Below, an embodiment of the invention is described in more detail using the drawings. Shown are.

DETAILED DESCRIPTION OF THE PREFERRED EMBODIMENTS

Figure 2:
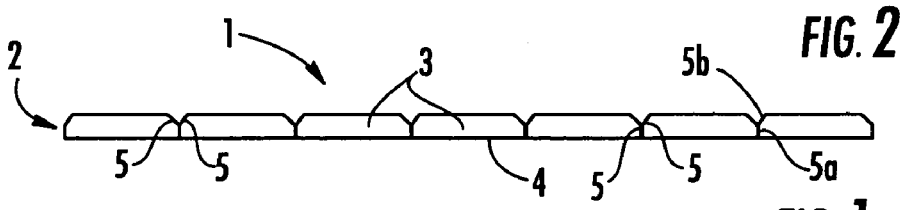
FIG. 2 is a view of this rectangular bed cover as in FIG. 1 towards its shorter edge, with a view onto the sides of the chambers located above a common cloth layer, whereby the bed cover is shown in its "summer position"

A bed cover labeled as 1 serves to retain the body heat of a sleeper according to the arrangement and description of DE 203 16 576 U1, which is incorporated herein by reference as if fully set forth, and to keep the sleeper warm. So that this retention of heat can be less in summer than in winter, bed cover 1 is usable in two opposite orientations, in which it is shown in very schematic form in FIG. 2 in its usage in summer and in FIG. 3 in its usage in winter—in each case without a sleeper and only in a spread position.

Bed cover 1 has divided or quilted lengthwise chambers 3 running parallel to its longer edges 2 and filled with a heat-insulting material such as feathers, down, wool, mixtures of the above, plastic fleece or the like, whereby the neighboring isolated chambers 3 are attached, especially sewn, to a flat cloth layer 4 forming one of the two outer surfaces of the bed cover 1.

As already described in DE 203 16 576 U1, when this flat cloth layer 4 is curved or bent in the sense of an arching of chambers 3, the neighboring boundaries or walls 5 of these chambers 3 can move apart and in the case of the reverse bending or curvature these boundaries or walls 5 come into contact along practically their entire height. Thus if bed cover 1 is arched upwards in its position shown in FIG. 2 because a sleeping person is lying beneath it, the directly neighboring boundaries or walls 5 move apart from one another, so that more heat can escape through bed cover 1. Such a usage is especially appropriate in case of greater external warmth, thus especially in summer.

Figure 3:
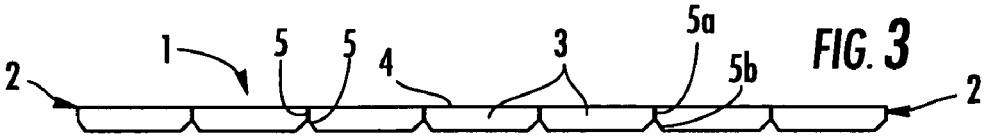
FIG. 3 is a view of the bed cover according to the invention corresponding to FIG. 2 in which it is turned 180° about its lengthwise axis from the position in FIG. 2 and is thus now in its "winter position"

If on the other hand bed cover 1 is arched upwards in the position shown in FIG. 3 by a sleeper located under this bed cover 1, then the walls 5 of directly neighboring chambers 3 are pressed firmly together, so that the areas of these boundaries or walls 5 visible in FIG. 3 as originally isolated move together and thus less heat can escape through bed cover 1, so that such a usage of bed cover 1 is especially appropriate in winter.

Figure 4:
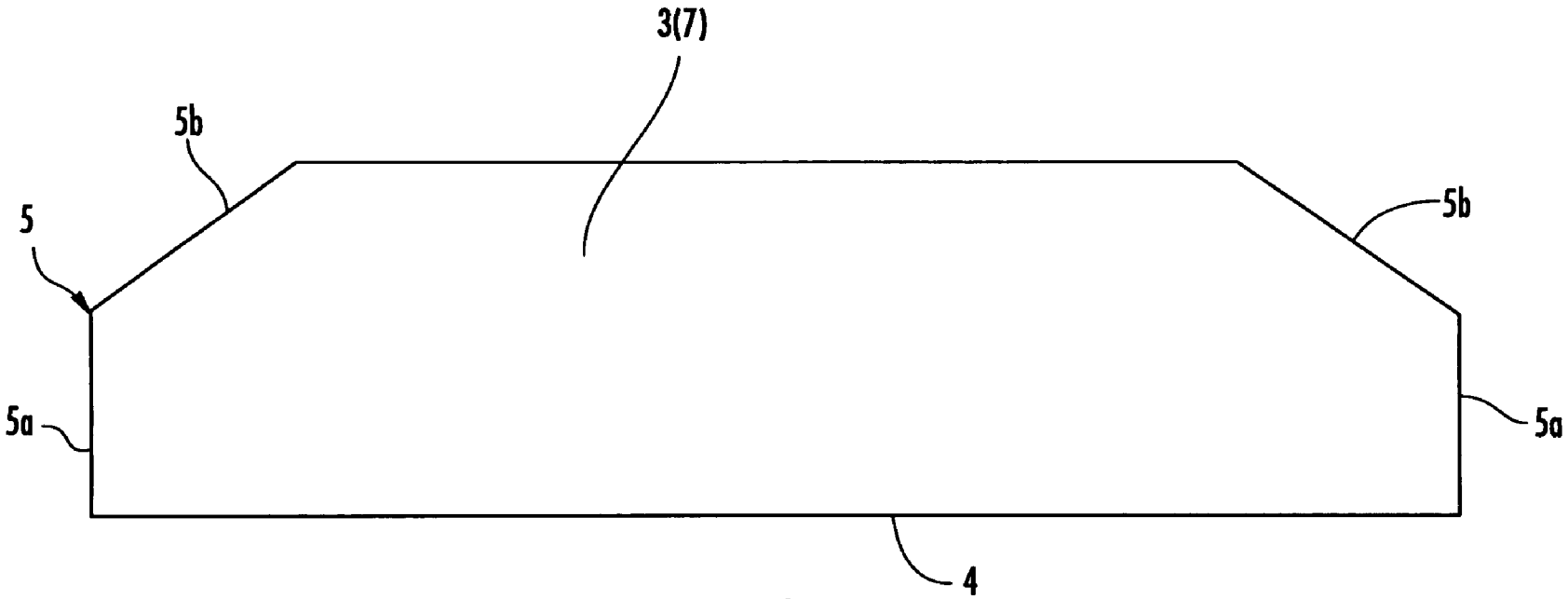
FIG. 4 is a schematic view of the cross-sectional form of a single chamber at an enlarged scale.

It can be seen in FIGS. 2, 3, and 4 that the neighboring boundaries or walls 5 of chamber 3 in the spread, non-arched position of bed cover 1 have a smaller gap in the first portion 5*a* of their extent outwards from cloth layer 4 than in the further portion 5*b* of this extent, or are in contact over the first portion 5*a* of their extent as in FIGS. 2 and 3.

If this bed cover 1 is arched upwards from its position shown in FIG. 2, these first portions 5*a* of the walls 5 move apart from one another and allow a good heat penetrability. If bed cover 1 is arched upwards in its position shown in FIG. 3 with cloth layer 4 on top, however, the boundaries or walls 5 and especially their first portions 5*a* are pressed correspondingly firmly together, so that the further areas or extents 5*b* of these walls 5 or the remainder after a corresponding bunching up of the chambers 3 are brought into contact with one another, whereby even with a slight arching there is already good heat insulation.

From FIGS. 2 through 4 it can be seen that in the example embodiment of the invention the boundaries or walls 5 of the chambers 3 in the spread or non-arched bed cover 1 lie together over about half their extent 5*a* outwards from the cloth layer, and in the further extent 5*b* they diverge or run apart from one another.

As shown in FIG. 4, the individual filled chambers 3 have a cross section roughly at right angles to the cloth layer 4 comprising a rectangle located directly on the cloth layer 4 and a trapezoid projecting from this. The boundary line between this imaginary rectangle and imaginary trapezoid is not shown in FIG. 4, since in reality there is no division of the chamber 3 at this location. The slanted sides of the trapezoid form the divergent areas 5*b* of the walls 5 or boundaries of the chambers 3, and the shorter side of the parallel boundaries of the trapezoid is located on the upper side of each chamber 3 away from the cloth layer.

The cross sections of the boundaries or walls 5 of the chambers 3 in the upper area 5*b* have an angle of about 45° from a horizontal or vertical plane. Experiments have shown that this results in a good opening of the neighboring edges or boundaries 5 when arched in the summer position, while in the winter position the areas 5*a* are pressed together particularly firmly and areas 5*b* are pressed together sufficiently well to achieve good heat insulation.

The size of a chamber 3 can, for example, be dimensioned as follows:

If the largest lower dimension in FIG. 4 is 20 cm, then the upper parallel dimension can be about 14 cm, while the first area 5*a* of wall 5 can have a dimension of 3 cm and the adjacent slanted area 5*a* can have a dimension of 4 cm. This results in a cross section satisfying one of the requirements of bed cover 1 to achieve good heat insulation in winter and less heat insulation in summer.

Figure 1:
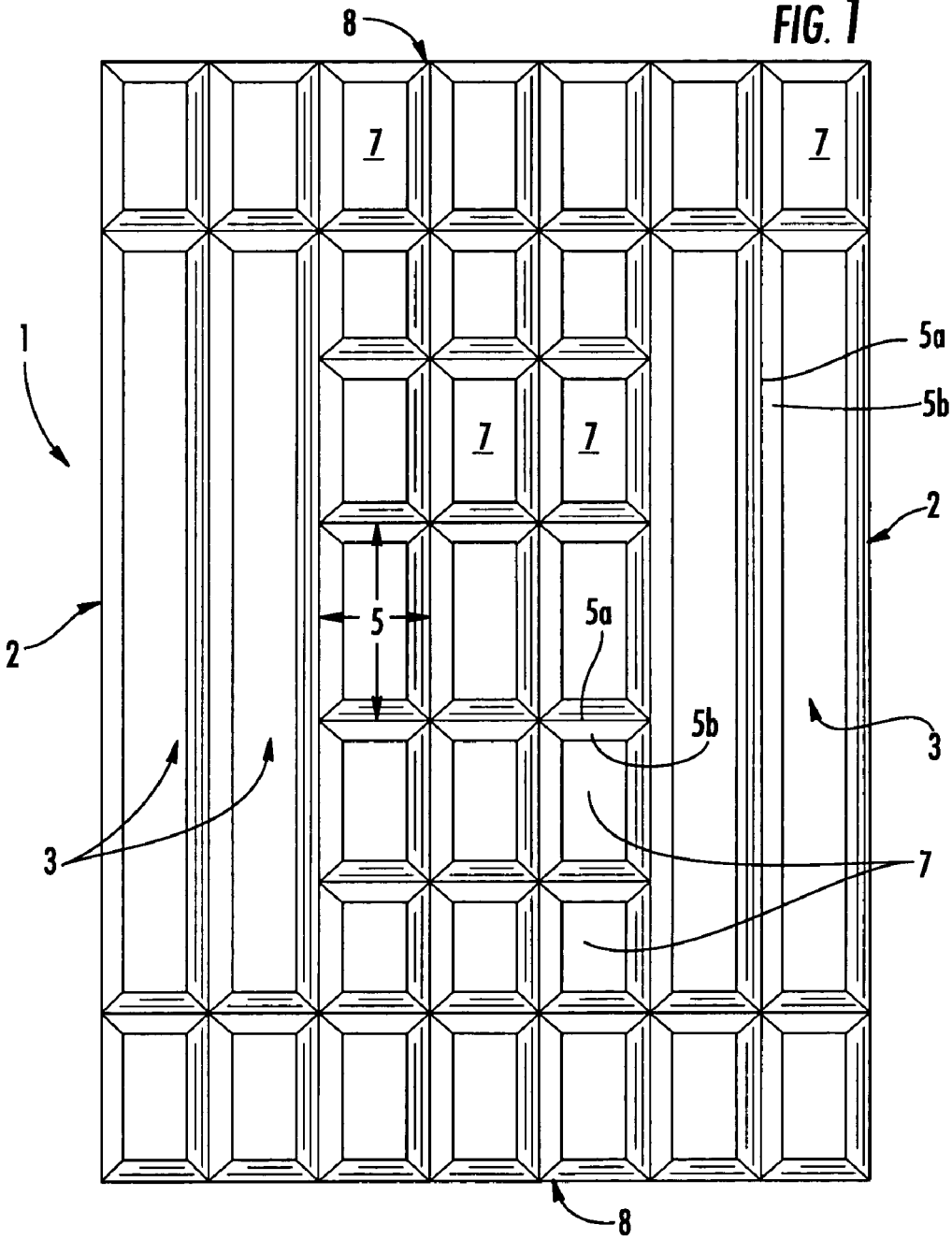
FIG. 1 is a top view of a rectangular bed cover according to the invention, with chambers running lengthwise and subdivision in to subchambers running across.

As shown in FIG. 1, some of the chambers 3 which run the entire length of bed cover 1 can be subdivided across their lengthwise extent, whereby the subchambers 7 resulting from the subdivision have a larger dimension in the lengthwise direction of the subdivided chambers 3 and the bed cover 1 than in the crosswise direction. The boundaries or walls 5 of the subchamber 7 also contact one another over at least the first portion 5*a* of their extent outwards from cloth layer 4, but could also have a smaller distance from one another and furthermore have an increasing distance from the neighboring walls or boundaries 5 in the further portion 5*b* of their extent, whereby this further extent of the walls 5 can especially have an angle of 45°. The subchambers 7 thus have in the lengthwise direction a similar cross-sectional form as in the crosswise direction shown in FIG. 4, and still have a somewhat longer length than that shown. It can be seen in FIG. 1 that these lengths of the subchambers 7 can each be different. Correspondingly, subchambers 7 can also be given square cross-sections or they could even have a shorter dimension in the lengthwise direction than in the crosswise direction of bed cover 1.

The boundaries 5 of chambers 4 and subchambers 7 also extend, even in the crosswise subdivisions, down to the cloth layer 4 and in a curvature or arching which moves them together, thus in the winter position, make contact over a surface, especially their entire surface, in order to provide the desired greater insulation in this arrangement.

At least the parallel chambers 4 located in the middle area of the bed cover 1 are each subdivided into multiple subchambers 7 in the crosswise direction. The chambers 4 located directly at the edge 2 of bed cover 1 and extending parallel to this edge are not subdivided, or in the example embodiment are only subdivided at both ends, thus can make a good seal to the side between the bed cover 1 and the mattress or similar bedding on which a sleeping person lies.

The chambers 4 and/or the subchamber 7 along with their dimensions and their number can therefore be laid out along the body, that is, roughly in the center of bed cover 1, where the hips of a sleeping person are located during use, there is a larger number of subchambers 7, so that in summer more heat can escape there, while in winter it is still possible to achieve good insulation.

The facing walls 5 of parallel, immediately neighboring chambers 3 can be fashioned of a common strip or piece of material, which especially in the middle is connected or sewn to the layers of cloth layer 4. At the edges of this strip or piece of material, which are thus still free, the pieces of material forming the upper side of the filled chambers can be attached or sewn in a single piece or as separate pieces.

At the edges of the side walls 5 of chambers 3 facing away from the underlying cloth layer 4, there can be a stabilizing seam running along the upper side of the chambers 3 facing away from the underlying cloth layer 4, which is not further shown in the figures. The transition from area 5*a* to area 5*b* of the boundary or wall 5 can also be stabilized using corresponding shaping seams, that is, at the transition from the first portion 5*a* of the extent of the wall or boundary 5 of chamber 3 to the second, slanted portion 5*b*, there can be a seam of suitable design.

The facing sides of the subchambers 7, in the area of their subdivision or the subdivision of the filled chambers 4, can be formed of sewn-in pieces of material and/or continuations of the strips forming the side walls.

The orientation of the bed cover 1 during use to a user or sleeper in the summer is shown in FIGS. 3 and 4 of DE 203 16 576 U1 and the orientation in winter as shown in FIG. 7 corresponds to this use pattern and is not shown in FIGS. 1 through 4.

The bed cover 1 with isolated or quilted chambers 3 running parallel to an edge 2 and filled with a heat-insulating material can be used either in summer or in winter in different orientations. The neighboring chambers 3, set back from one another, are attached, especially sewn, to a flat cloth layer 4 forming one of the two surfaces of the bed cover 1, or to a similar flat part, so that when this flat layer 4 is curved or bent in the sense of an arching of the chambers 3, the neighboring boundaries or walls 5 are moved apart, while in the case of an opposing bend or curvature these boundaries or walls 5 come into contact with one another, resulting in improved insulation. The design is such that in a flat, non-arched position of the bed cover 1 the neighboring boundaries or walls 5 have a smaller distance from one another over a first portion 5*a* of their extent than over a further portion 5*b*, or that in at least a first portion 5*a* of their extent they are in contact with one another. Especially in the position for winter use, this results in a good insulation effect even in the case of only slight curvature.

The invention claimed is:

1. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) are in contact with one another for roughly half of the outward extent (5*a*) thereof from the cloth layer and diverge or run away from one another for the further portion of the outward extent (5*b*).

2. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least the first portion (5*a*) of the outward extent, and the individual filled chambers (3) have a cross-section roughly perpendicular to the cloth layer (4) comprising a rectangle located directly at the cloth layer (4) and a trapezoid projecting therefrom, whereby slanted sides of the trapezoid form diverging areas defining the further portion (5*b*) of the walls (5) or boundaries of the chambers (3) and a shorter side of the parallel boundaries of the trapezoid is located on an upper side of the chambers (3) facing away from the cloth layer (4).

3. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least the first portion (5*a*) of the outward extent, and at least some of the chambers (3) are subdivided across a lengthwise extent thereof into individual subchambers (7), the subchambers resulting from the subdivision have a greater dimension in a lengthwise direction of the chambers (3) than in a cross direction, and boundaries (5) of the subchambers (7) at the subdivisions also have a smaller distance from one another in the first portion (5*a*) of the outward extent thereof from the cloth layer (4) or are in contact with one another and/or the further portion (5*b*) of the outward extent has an increasing distance between neighboring ones of the walls (5) or boundaries, whereby the further extent of the walls (5) extends at an angle of about 450°.

4. Bed cover according to claim 3, wherein the boundaries (5) of the chambers (4) and the subchambers (7) extend down to the cloth layer (4) even in cross-wise subdivisions and come in contact with one another when bent or arched together along a surface thereof.

5. Bed cover according to claim 3, wherein the chambers (4) and/or the subchambers (7) along with dimensions and a number thereof are arranged according to a user's body.

6. Bed cover according to claim 3, wherein facing sides of the subchambers (7) in an area of their subdivision of the filled chambers (4) are formed by pieces of material sewn in and/or continuations of the strips forming the side walls.

7. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least the first portion (5*a*) of the outward extent, and parallel chambers are located in a central area of the bed cover, and at least the parallel chambers (4) in the central area of the bed cover (1) are subdivided into subchambers (7) in a cross-wise direction.

8. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least the first portion (5*a*) of the outward extent, and at least the chambers (4) located directly at the edge (2) of the bed cover (1) and extending parallel to the edge are not subdivided or are subdivided only near to one or both ends thereof.

9. Bed cover (1) comprising isolated or quilted chambers (3) running parallel to one edge (2) of the bed cover and filled with a heat-insulating material, whereby neighboring ones of the separate chambers (3) are attached by sewing to a flat cloth layer (4) forming one of two surfaces of the bed cover (1), so that when the flat cloth layer (4) is bent or curved in a sense of an arching of the chambers (3), neighboring boundaries or walls (5) of the chambers (3) can be or are moved apart from one another, and upon a bend or curvature in an opposite direction the boundaries or walls (5) of the filled chambers (3) come into contact with one another, wherein in a spread, non-arched position of the bed cover (1), the neighboring boundaries or walls (5) of the chambers (3) have a smaller distance from one another over a first portion (5*a*) of an outward extent thereof from the cloth layer (4) than in a further portion (5*b*) of the outward extent, or are in contact for at least the first portion (5*a*) of the outward extent, and the cover is rectangular and has a plurality of edges, and the chambers (4) extend parallel to longer ones of the edges (2) of the bed cover (1) and a subdivision of the chambers (4) into subchambers (7) is oriented parallel to shorter ones of the edges (8) of the bed cover (1).

10. Bed cover according to claim 9, wherein the subdivision(s) of the parallel chambers (4) run into one another.

11. Bed cover according to claim 9, wherein a length of isolated ones of the subchambers (7) is roughly one and a half to three times a width thereof.

* * * * *

UNITED STATES PATENT AND TRADEMARK OFFICE

CERTIFICATE OF CORRECTION

PATENT NO. : 7,162,756 B2
APPLICATION NO. : 11/108365
DATED : January 16, 2007
INVENTOR(S) : Erich Schweigert It is certified that error appears in the above-identified patent and that said Letters Patent is hereby corrected as shown below:

Column 7, line 42, after the word "about", delete "450°" and insert therefor --45°--.

Signed and Sealed this

Third Day of June, 2008

JON W. DUDAS
*Director of the United States Patent and Trademark Office*